US009556717B2

(12) United States Patent
Rout

(10) Patent No.: US 9,556,717 B2
(45) Date of Patent: Jan. 31, 2017

(54) NON-AQUEOUS HYDROCARBON RECOVERY

(76) Inventor: Bruce Rout, Calgary (CA)

( * ) Notice: Subject to any disclaimer, the term of this patent is extended or adjusted under 35 U.S.C. 154(b) by 272 days.

(21) Appl. No.: 13/806,516

(22) PCT Filed: Oct. 11, 2011

(86) PCT No.: PCT/CA2011/001120
§ 371 (c)(1),
(2), (4) Date: Jan. 21, 2013

(87) PCT Pub. No.: WO2012/055009
PCT Pub. Date: May 3, 2012

(65) Prior Publication Data
US 2014/0144621 A1 May 29, 2014

Related U.S. Application Data

(60) Provisional application No. 61/391,325, filed on Oct. 27, 2010, provisional application No. 61/444,311, filed on Feb. 18, 2011.

(51) Int. Cl.
*E21B 43/16* (2006.01)
*C10G 1/04* (2006.01)
(Continued)

(52) U.S. Cl.
CPC ..... *E21B 43/16* (2013.01); *C10G 1/04* (2013.01); *C10G 21/12* (2013.01); *C10G 21/14* (2013.01);
(Continued)

(58) Field of Classification Search
CPC ..... E21B 43/003
See application file for complete search history.

(56) References Cited

U.S. PATENT DOCUMENTS 3,497,005 A * 2/1970 Pelopsky et al. ..... 166/247
4,054,506 A 10/1977 Hart, Jr. et al.
(Continued)

FOREIGN PATENT DOCUMENTS

CA 633063 12/1961
RU 2241829 12/2003

OTHER PUBLICATIONS

Matouq, M. et al, Solvent Extraction of Bitumen from Jordan Oil Shale Assisted by Low Frequency Ultrasound, Journal of Japan Petroleum Institute, 2009, p. 265-269, vol. 52:5.

*Primary Examiner* — Angela M DiTrani
*Assistant Examiner* — Andrew H Sue-Ako
(74) *Attorney, Agent, or Firm* — Eduardo Krupnik; Miller Thomson LLP

(57) ABSTRACT

The present invention relates to in situ methods of separating, refining and extracting hydrocarbons from an oil formation. In embodiments of the present invention the in situ methods includes: (a) making a perforation in the oil sand formation, (b) disposing a non-polar substance into the perforation without addition of polar fluid, (c) subjecting the non-polar fluid composition disposed in the perforation to ultrasonic vibrations, and (d) extracting the hydrocarbon from the perforation in the oil sand formation. The present invention relates also to methods of separating, refining and extracting hydrocarbons from hydrocarbon matrices such as oil sand or oil shale.

22 Claims, 11 Drawing Sheets

(51) Int. Cl.

| | |
|---|---|
| ***C10G 21/12*** | (2006.01) |
| ***C10G 21/14*** | (2006.01) |
| ***C10G 32/02*** | (2006.01) |
| ***E21B 43/00*** | (2006.01) |

(52) U.S. Cl.
CPC ..... *C10G 32/02* (2013.01); *E21B 43/003* (2013.01); *C10G 2300/4037* (2013.01); *C10G 2300/44* (2013.01); *C10G 2300/805* (2013.01)

(56) References Cited

U.S. PATENT DOCUMENTS

| | | | | |
|---|---|---|---|---|
| 4,164,978 | A * | 8/1979 | Scott | E21B 43/003 166/177.1 |
| 5,824,214 | A * | 10/1998 | Paul | C10G 15/08 166/247 |
| 6,390,191 | B1 * | 5/2002 | Melson | E21B 43/003 166/177.1 |
| 7,980,312 | B1 * | 7/2011 | Hill et al. | 166/303 |
| 2005/0006088 | A1 * | 1/2005 | Abramov | E21B 43/003 166/249 |
| 2008/0139418 | A1 | 6/2008 | Cioletti et al. | |
| 2009/0173664 | A1 * | 7/2009 | Choi | C10G 9/00 208/85 |
| 2015/0041369 | A1 * | 2/2015 | Rout | C10G 32/02 208/390 |

* cited by examiner

Boiling Point Table
ASTM D7169
Carbon(0) Channel

| %Off | BP(C) | %Off | BP(C) | %Off | BP(C) |
|---|---|---|---|---|---|
| IBP | 106.3 | 36.00 | 141.0 | 72.00 | 538.6 |
| 1.00 | 106.8 | 37.00 | 141.9 | 73.00 | 551.2 |
| 2.00 | 110.8 | 38.00 | 142.7 | 74.00 | 564.0 |
| 3.00 | 113.1 | 39.00 | 143.1 | 75.00 | 575.8 |
| 4.00 | 115.6 | 40.00 | 143.5 | 76.00 | 587.5 |
| 5.00 | 133.0 | 41.00 | 143.8 | 77.00 | 598.2 |
| 6.00 | 133.8 | 42.00 | 144.0 | 78.00 | 608.6 |
| 7.00 | 134.7 | 43.00 | 144.3 | 79.00 | 618.2 |
| 8.00 | 135.3 | 44.00 | 144.5 | 80.00 | 627.4 |
| 9.00 | 135.8 | 45.00 | 144.8 | 81.00 | 635.5 |
| 10.00 | 136.2 | 46.00 | 145.0 | 82.00 | 643.5 |
| 11.00 | 136.5 | 47.00 | 152.8 | 83.00 | 651.2 |
| 12.00 | 136.8 | 48.00 | 197.3 | 84.00 | 658.2 |
| 13.00 | 137.0 | 49.00 | 240.9 | 85.00 | 667.5 |
| 14.00 | 137.3 | 50.00 | 267.2 | 86.00 | 667.2 |
| 15.00 | 137.5 | 51.00 | 288.5 | 87.00 | 688.1 |
| 16.00 | 137.7 | 52.00 | 304.5 | 88.00 | 698.7 |
| 17.00 | 137.9 | 53.00 | 318.8 | 89.00 | 709.6 |
| 18.00 | 138.1 | 54.00 | 332.2 | 90.00 | 722.2 |
| 19.00 | 138.3 | 55.00 | 345.0 | 91.00 | 736.7 |
| 20.00 | 138.5 | 56.00 | 357.0 | | |
| 21.00 | 138.7 | 57.00 | 368.7 | | |
| 22.00 | 138.8 | 58.00 | 380.6 | | |
| 23.00 | 139.0 | 59.00 | 392.4 | | |
| 24.00 | 139.2 | 60.00 | 403.9 | | |
| 25.00 | 139.3 | 61.00 | 414.8 | | |
| 26.00 | 139.5 | 62.00 | 424.8 | | |
| 27.00 | 139.6 | 63.00 | 434.9 | | |
| 28.00 | 139.8 | 64.00 | 445.8 | | |
| 29.00 | 139.9 | 65.00 | 456.7 | | |
| 30.00 | 140.1 | 66.00 | 467.9 | | |
| 31.00 | 140.2 | 67.00 | 479.1 | | |
| 32.00 | 140.4 | 68.00 | 491.0 | | |
| 33.00 | 140.5 | 69.00 | 502.5 | | |
| 34.00 | 140.7 | 70.00 | 513.8 | | |
| 35.00 | 140.8 | 71.00 | 525.8 | | |

FIG. 2

Cut Point Table-1 (%Off)
ASTM D7169
Carbon(0) Channel

| Cut(C) | %Off | Name |
|---|---|---|
| (C5, C6) | 0.00 | |
| (C6, C7) | 0.04 | |
| (C7, C8) | 4.54 | |
| (C8, C9) | 42.16 | |
| (C9, C10) | 0.73 | |
| (C10, C11) | 0.49 | |
| (C11, C12) | 0.47 | |
| (C12, C13) | 0.44 | |
| (C13, C14) | 0.61 | |
| (C14, C15) | 0.68 | |
| (C15, C16) | 0.76 | |
| (C16, C17) | 0.92 | |
| (C17, C18) | 0.99 | |
| (C18, C19) | 1.02 | |
| (C19 C20) | 1.01 | |
| (C20, C21) | 1.10 | |
| (C21, C22) | 1.03 | |
| (C22, C23) | 0.97 | |
| (C23, C24) | 0.94 | |
| (C24, C25) | 0.92 | |
| (C25, C26) | 0.93 | |
| (C26, C27) | 0.97 | |
| (C27, C28) | 0.93 | |
| (C28, C29) | 0.86 | |
| (C29, C30) | 0.81 | |
| C30, C31) | 0.77 | |
| (C31, C32) | 0.73 | |
| (C32, C33) | 0.74 | |
| (C33, C34) | 0.61 | |
| (C34, C35) | 0.67 | |
| (C35, C36) | 0.60 | |
| (C36, C37) | 0.61 | |
| (C37, C38) | 0.53 | |
| (C38, C39) | 0.61 | |
| (C39, C40) | 0.50 | |
| (C40, C41) | 0.49 | |

FIG. 3

Cut Point Table-1 (%Off)

ASTM D7169

*Carbon(0) Channel*

| Cut(C) | %Off | Name |
|---|---|---|
| ( C41, C42 ) | 0.47 | |
| ( C42, C43 ) | 0.47 | |
| ( C43, C44 ) | 0.40 | |
| ( C44, C45 ) | 0.40 | |
| ( C45, C46 ) | 0.47 | |
| ( C46, C47 ) | 0.39 | |
| ( C47, C48 ) | 0.41 | |
| ( C48, C49 ) | 0.33 | |
| ( C49, C50 ) | 0.43 | |
| ( C50, C51 ) | 0.34 | |
| ( C51, C52 ) | 0.42 | |
| ( C52, C53 ) | 0.35 | |
| ( C53, C54 ) | 0.39 | |
| ( C54, C55 ) | 0.35 | |
| ( C55, C56 ) | 0.38 | |
| ( C56, C57 ) | 0.39 | |
| ( C57, C58 ) | 0.36 | |
| ( C58, C59 ) | 0.43 | |
| ( C59, C60 ) | 0.31 | |
| ( C60, C61 ) | 0.42 | |
| ( C61, C62 ) | 0.35 | |
| ( C62, C63 ) | 0.30 | |
| ( C63, C64 ) | 0.45 | |
| ( C64, C65 ) | 0.38 | |
| ( C65, C66 ) | 0.37 | |
| ( C66, C67 ) | 0.37 | |
| ( C67, C68 ) | 0.39 | |
| ( C68, C69 ) | 0.36 | |
| ( C69, C70 ) | 0.42 | |
| ( C70, C71 ) | 0.36 | |
| ( C71, C72 ) | 0.38 | |
| ( C72, C73 ) | 0.32 | |
| ( C73, C74 ) | 0.40 | |
| ( C74, C75 ) | 0.36 | |
| ( C75, C76 ) | 0.31 | |
| ( C76, C77 ) | 0.33 | |

Cut Point Table-1 (%Off)

ASTM D7169

*Carbon(0) Channel*

| Cut(C) | %Off | Name |
|---|---|---|
| ( C77, C78 ) | 0.31 | |
| ( C78, C79 ) | 0.21 | |
| ( C79, C80 ) | 0.31 | |
| ( C80, C81 ) | 0.30 | |
| ( C81, C82 ) | 0.28 | |
| ( C82, C83 ) | 0.26 | |
| ( C83, C84 ) | 0.19 | |
| ( C84, C85 ) | 0.27 | |
| ( C85, C86 ) | 0.20 | |
| ( C86, C87 ) | 0.18 | |
| ( C87, C88 ) | 0.19 | |
| ( C88, C89 ) | 0.24 | |
| ( C89, C90 ) | 0.23 | |
| ( C90, C91 ) | 0.18 | |
| ( C91, C92 ) | 0.17 | |
| ( C92, C93 ) | 0.19 | |
| ( C93, C94 ) | 0.16 | |
| ( C94, C95 ) | 0.20 | |
| ( C95, C96 ) | 0.18 | |
| ( C96, C97 ) | 0.14 | |
| ( C97, C98 ) | 0.17 | |
| ( C98, C99 ) | 0.15 | |
| ( C99, C100 ) | 0.16 | |

FIG. 3 (continue)

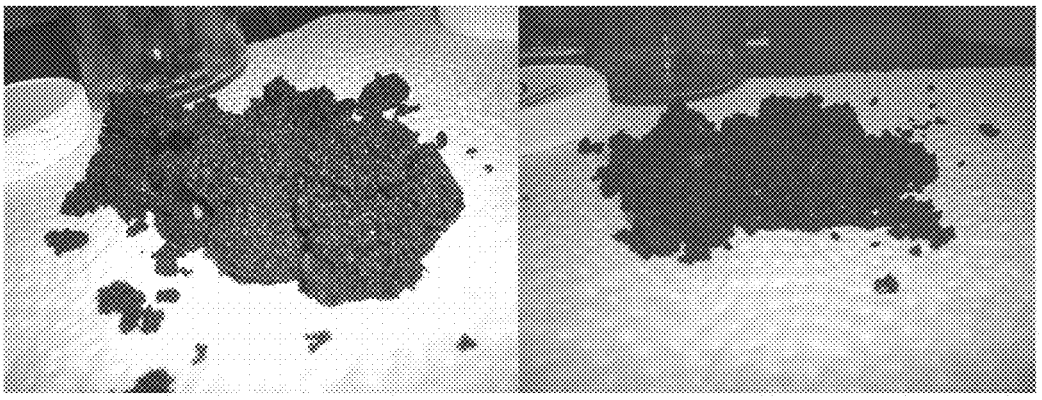
FIG. 4a FIG. 4b
FIG. 4
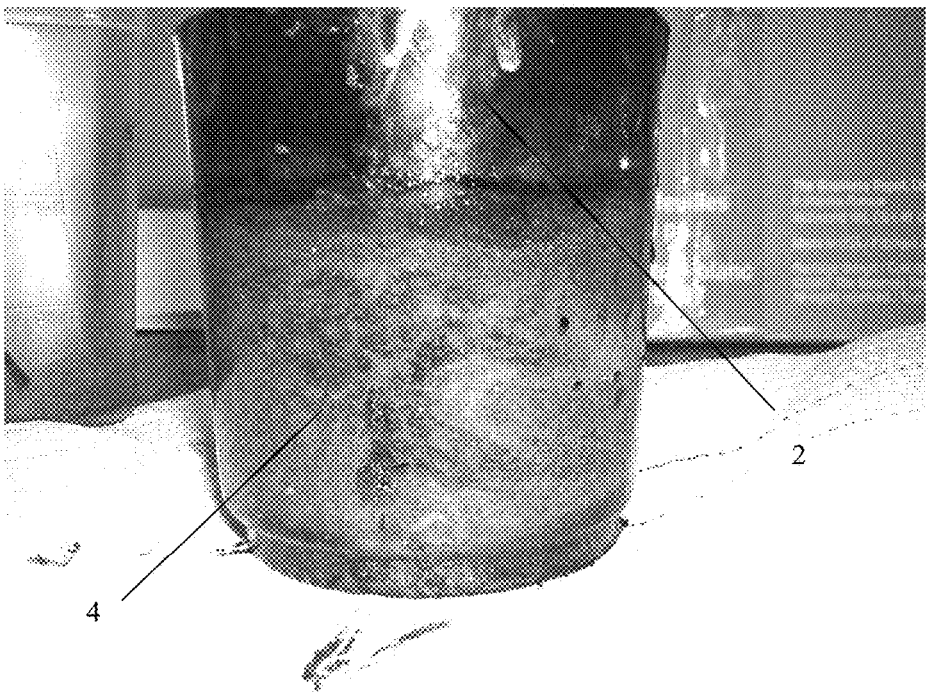
FIG. 5

Carbon profile changes with Pentane as a solvent ( ——)

Raw Oil Sand Sample
Analysis of C30+ Fraction

| Boiling Point: Range (° C) | Component | Carbon Number | Mole Fraction | Mass Fraction | Liq. Vol. Fraction |
|---|---|---|---|---|---|
| -161.7 | Methane | C 1 | 0.0000 | 0.0000 | 0.0000 |
| -88.9 | Ethane | C 2 | 0.0000 | 0.0000 | 0.0000 |
| -42.2 | Propane | C 3 | 0.0000 | 0.0000 | 0.0000 |
| -11.7 | Iso Butane | C 4 | 0.0000 | 0.0000 | 0.0000 |
| -0.6 | Normal Butane | C 4 | 0.0000 | 0.0000 | 0.0000 |
| 27.8 | Iso Pentane | C 5 | 0.0000 | 0.0000 | 0.0000 |
| 36.1 | Normal Pentane | C 5 | 0.0000 | 0.0000 | 0.0000 |
| 36.1- 68.9 | Hexanes | C 6 | 0.0000 | 0.0000 | 0.0000 |
| 68.9- 98.3 | Heptanes | C 7 | 0.0000 | 0.0000 | 0.0000 |
| 98.3-125.6 | Octanes | C 8 | 0.0000 | 0.0000 | 0.0000 |
| 125.6-150.6 | Nonanes | C 9 | 0.0000 | 0.0000 | 0.0000 |
| 150.6-173.9 | Decanes | C 10 | 0.0003 | 0.0001 | 0.0001 |
| 173.9-196.1 | Undecanes | C 11 | 0.0019 | 0.0006 | 0.0007 |
| 196.1-215.0 | Dodecanes | C 12 | 0.0047 | 0.0016 | 0.0018 |
| 215.0-235.0 | Tridecanes | C 13 | 0.0086 | 0.0032 | 0.0035 |
| 235.0-252.2 | Tetradecanes | C 14 | 0.0132 | 0.0053 | 0.0058 |
| 252.2-270.6 | Pentadecanes | C 15 | 0.0190 | 0.0083 | 0.0089 |
| 270.6-287.8 | Hexadecanes | C 16 | 0.0247 | 0.0116 | 0.0124 |
| 287.8-302.8 | Heptadecanes | C 17 | 0.0277 | 0.0139 | 0.0147 |
| 302.8-317.2 | Octadecanes | C 18 | 0.0312 | 0.0166 | 0.0174 |
| 317.2-330.0 | Nonadecanes | C 19 | 0.0318 | 0.0177 | 0.0184 |
| 330.0-344.4 | Eicosanes | C 20 | 0.0326 | 0.0190 | 0.0197 |
| 344.4-357.2 | Heneicosanes | C 21 | 0.0292 | 0.0180 | 0.0185 |
| 357.2-369.4 | Docosanes | C 22 | 0.0319 | 0.0206 | 0.0211 |
| 369.4-380.0 | Tricosanes | C 23 | 0.0256 | 0.0172 | 0.0175 |
| 380.0-391.1 | Tetracosanes | C 24 | 0.0251 | 0.0176 | 0.0178 |
| 391.1-401.7 | Pentacosanes | C 25 | 0.0238 | 0.0174 | 0.0175 |
| 401.7-412.2 | Hexacosanes | C 26 | 0.0213 | 0.0162 | 0.0163 |
| 412.2-422.2 | Heptacosanes | C 27 | 0.0212 | 0.0168 | 0.0168 |
| 422.2-431.7 | Octacosanes | C 28 | 0.0195 | 0.0160 | 0.0160 |
| 431.7-441.1 | Nonacosanes | C 29 | 0.0188 | 0.0160 | 0.0159 |
| 441.1 PLUS | Triacontanes Plus | C 30+ | 0.5879 | 0.7463 | 0.7392 |
| | | | | | |
| 80 | Benzene | C 6 H 6 | 0.0000 | 0.0000 | 0.0000 |
| 110.6 | Toluene | C 7 H 8 | 0.0000 | 0.0000 | 0.0000 |
| 136.1-138.9 | Ethylbenzene, p + m-Xylene | C 8 H 10 | 0.0000 | 0.0000 | 0.0000 |
| 144.4 | o-Xylene | C 8 H 10 | 0.0000 | 0.0000 | 0.0000 |
| 168.9 | 1,2,4 Trimethylbenzene | C 9 H 12 | 0.0000 | 0.0000 | 0.0000 |
| | | | | | |
| 48.9 | Cyclopentane | C 5 H 10 | 0.0000 | 0.0000 | 0.0000 |
| 72.2 | Methylcyclopentane | C 6 H 12 | 0.0000 | 0.0000 | 0.0000 |
| 81.1 | Cyclohexane | C 6 H 12 | 0.0000 | 0.0000 | 0.0000 |
| 101.1 | Methylcyclohexane | C 7 H 14 | 0.0000 | 0.0000 | 0.0000 |
| | TOTAL | | 1.0000 | 1.0000 | 1.0000 |

FIG. 8

SF-840™ FRACTURING FLUID
Analysis of C30+ Fraction

| Boiling Point: Range (° C) | Component | Carbon Number | Mole Fraction | Mass Fraction | Liq. Vol. Fraction |
|---|---|---|---|---|---|
| -161.7 | Methane | C 1 | Trace | Trace | Trace |
| -88.9 | Ethane | C 2 | 0.0000 | 0.0000 | 0.0000 |
| -42.2 | Propane | C 3 | 0.0000 | 0.0000 | 0.0000 |
| -11.7 | Iso Butane | C 4 | 0.0000 | 0.0000 | 0.0000 |
| -0.6 | Normal Butane | C 4 | Trace | Trace | Trace |
| 27.8 | Iso Pentane | C 5 | Trace | Trace | Trace |
| 36.1 | Normal Pentane | C 5 | Trace | Trace | Trace |
| 36.1- 68.9 | Hexanes | C 6 | 0.0006 | 0.0003 | 0.0003 |
| 68.9- 98.3 | Heptanes | C 7 | 0.0016 | 0.0009 | 0.0010 |
| 98.3-125.6 | Octanes | C 8 | 0.0163 | 0.0102 | 0.0118 |
| 125.6-150.6 | Nonanes | C 9 | 0.0476 | 0.0335 | 0.0377 |
| 150.6-173.9 | Decanes | C 10 | 0.0917 | 0.0715 | 0.0792 |
| 173.9-196.1 | Undecanes | C 11 | 0.1278 | 0.1030 | 0.1061 |
| 196.1-215.0 | Dodecanes | C 12 | 0.1270 | 0.1121 | 0.1139 |
| 215.0-235.0 | Tridecanes | C 13 | 0.1276 | 0.1224 | 0.1224 |
| 235.0-252.2 | Tetradecanes | C 14 | 0.1060 | 0.1104 | 0.1092 |
| 252.2-270.6 | Pentadecanes | C 15 | 0.0907 | 0.1024 | 0.1001 |
| 270.6-287.8 | Hexadecanes | C 16 | 0.0717 | 0.0873 | 0.0845 |
| 287.8-302.8 | Heptadecanes | C 17 | 0.0527 | 0.0685 | 0.0657 |
| 302.8-317.2 | Octadecanes | C 18 | 0.0410 | 0.0564 | 0.0538 |
| 317.2-330.0 | Nonadecanes | C 19 | 0.0338 | 0.0487 | 0.0462 |
| 330.0-344.4 | Eicosanes | C 20 | 0.0137 | 0.0207 | 0.0195 |
| 344.4-357.2 | Heneicosanes | C 21 | 0.0097 | 0.0154 | 0.0145 |
| 357.2-369.4 | Docosanes | C 22 | 0.0070 | 0.0117 | 0.0109 |
| 369.4-380.0 | Tricosanes | C 23 | 0.0022 | 0.0038 | 0.0036 |
| 380.0-391.1 | Tetracosanes | C 24 | 0.0013 | 0.0024 | 0.0022 |
| 391.1-401.7 | Pentacosanes | C 25 | 0.0001 | 0.0002 | 0.0002 |
| 401.7-412.2 | Hexacosanes | C 26 | 0.0001 | 0.0001 | 0.0002 |
| 412.2-422.2 | Heptacosanes | C 27 | 0.0000 | 0.0000 | 0.0000 |
| 422.2-431.7 | Octacosanes | C 28 | 0.0000 | 0.0000 | 0.0000 |
| 431.7-441.1 | Nonacosanes | C 29 | 0.0000 | 0.0000 | 0.0000 |
| 441.1 PLUS | Triacontanes Plus | C 30+ | 0.0000 | 0.0000 | 0.0000 |
| 80 | Benzene | C 6 H 6 | Trace | Trace | Trace |
| 110.6 | Toluene | C 7 H 8 | 0.0010 | 0.0005 | 0.0005 |
| 136.1-138.9 | Ethylbenzene, p + m-Xylene | C 8 H 10 | 0.0088 | 0.0051 | 0.0048 |
| 144.4 | o-Xylene | C 8 H 10 | 0.0053 | 0.0031 | 0.0028 |
| 168.9 | 1,2,4 Trimethylbenzene | C 9 H 12 | 0.0126 | 0.0083 | 0.0077 |
| 48.9 | Cyclopentane | C 5 H 10 | Trace | Trace | Trace |
| 72.2 | Methylcyclopentane | C 6 H 12 | 0.0002 | 0.0001 | 0.0001 |
| 81.1 | Cyclohexane | C 6 H 12 | 0.0002 | 0.0001 | 0.0001 |
| 101.1 | Methylcyclohexane | C 7 H 14 | 0.0017 | 0.0009 | 0.0010 |
| | TOTAL | | 1.0000 | 1.0000 | 1.0000 |

FIG. 11

NON-AQUEOUS HYDROCARBON RECOVERY

CROSS REFERENCE TO RELATED APPLICATIONS

This application is a national stage application under 35 U.S.C. 371 of International Application No. PCT/CA2011/001120, filed Oct. 11, 2011, which in turn claims the benefit under 35 U.S.C. 119(e) of U.S. Provisional Ser. No. 61/391,325, filed Oct. 27, 2010 and of U.S. Provisional Ser. No. 61/444,311, filed Feb. 18, 2011, the contents of each of which are hereby incorporated by reference into the present disclosure.

FIELD OF THE INVENTION

The present invention relates to production of valuable hydrocarbons, including bitumen, from a hydrocarbon matrix. Particularly, the present invention relates to methods of separating, refining and extracting hydrocarbons from a hydrocarbon matrix using ultrasound and a non-polar substance as ultrasonic media and without the addition or requirement of polar fluids such as water. The invention relates also to in situ and on surface refinement and extraction of hydrocarbons from oil formations using ultrasound and a non-polar substance without the addition or requirement of water.

BACKGROUND OF THE INVENTION

Crude oil or petroleum consists of a mixture of different hydrocarbons. The most commonly found hydrocarbon molecules in crude oil are alkanes (linear or branched), cycloalkanes, aromatic hydrocarbons, or more complicated chemicals like asphaltenes.

Oil sands, which may also be referred to as tar sands, are a type of unconventional petroleum deposit. In the Athabasca region of northern Alberta lie the Athabasca oil sand deposits, one of the largest reserves of oil in the world. The oil sands consist essentially of a matrix of bitumen, sand, water and clay which has a very high viscosity and is therefore practically immobile. The bitumen may be some times defined as a form of extra heavy oil and is extremely difficult to extract.

Methods used to separate the bitumen from the sand require significant energy, chemicals and/or water. In certain circumstances, the sands can be extracted by strip mining, or the bitumen can be made to flow into wells by in situ techniques, which reduce the viscosity by injecting steam, solvents, and/or hot air into the sands.

Presently, SAGD, (steam assisted gravity drainage), is most commonly used to extract the bitumen from the deposits below 400 m depth. The SAGD process requires vast amounts of water and natural gas and has, therefore, a large environmental impact.

Once separated from the sand, lighter oils and hydrocarbons can be obtained from crude oil and heavier hydrocarbons through cracking processes involving distillation of crude oils in processing plants. Cracking, or refining, is the overall reduction of lengths of hydrocarbon chains, usually in alkanes.

Methods used to distill and process lighter from heavier hydrocarbons require significant use of energy and processing infrastructure. Raw crude hydrocarbons are extracted from deposits, piped or delivered in some other manner to distillation plants, and submitted to cracking processes known as refining. Heavier oils, particularly bitumen, may need to be mixed with solvents in order to facilitate delivery.

Ultrasonics has been attempted for in situ oil sand extraction processes previously but only using water as an ultrasonic media. Ultrasonics requires some media for sound to travel through in order for sound to come into contact with oil sand. Using water as sonic media has not proven economically viable for in situ bitumen recovery since the water cannot penetrate very far into the oil sand matrix due to the immiscible nature of oil and water.

U.S. Pat. No. 4,054,506 provides for a method of removing bitumen from oil sand for subsequent recovery of the bitumen. The method disclosed in this patent application, however, utilizes an above-ground vessel into which mined oil sand, broken down into small segments, is placed. The method disclosed in this patent consists of contacting oil sand matrix with an excess of solvent in which the bitumen is soluble. The contacting is performed within a vessel, and simultaneously the solvent is being stirred and ultrasonic energy is being applied. Both stirring and breaking down the oil sand into small segments incorporates air into the ultrasonic media and greatly detracts from the effectiveness of using ultrasonics as a separation process. That is, the extraction of bitumen from oil sand occurs after the oil sands are mined to the surface, broken down into quarter (¼) inch segments, and stirred within a vessel while ultrasonics are applied. Usually these methods require large expensive machinery or vessels and expose the environment and humans to toxic chemicals. Because of the incorporation of air into the ultrasonic media, the process has a reduced effectiveness.

US Pat. Publ. No. 20080139418 (US '418) discloses an in situ method for extracting bitumen from sand consisting of adding a release agent directly to the oil sand, followed by the use of an alkaline water-based extraction liquid for washing the loosened bitumen which is then pumped to the surface. Ultrasonic transducers are used within a tank (i.e. ex situ), and only to separate remaining sand bound to bitumen. In summary, the extraction method of US '418 uses water and ultrasonic transducers ex situ.

The abstract of Russian Patent No. 2,241,829 (Orlov at al.) describes a method for treating face-adjacent bed areas. The method consists of replacing the well liquid with hydrocarbon liquid (a water-less oil), pumping and partially pushing a treating compound into the bed, the level of the hydrocarbon liquid in the well is lowered down to mark at which bed pressure is 1.52 to 2 times greater than the face pressure. Under such conditions implosive treatment is performed. Then an ultrasound emitter is lowered and ultrasound treatment of face-adjacent bed area is performed. The method disclosed by Orlov at al, however, does not relate to in situ methods of extracting and separating hydrocarbons from a hydrocarbon matrix in an oil formation, of relining heavy crude oil in an oil formation, or of processing an oil formation. Furthermore, the method of Orlov et al. requires implosive treatment of the oil well, which increases the threat of explosions or blowouts. Accordingly, what is needed are in situ methods of extracting and separating hydrocarbons from a hydrocarbon matrix in an oil formation, of refining heavy crude oil or processing an oil formation that can be carried out at low pressure by pouring or disposing a treating compound into a well without the necessity of high-pressure injection pumps.

Needed are methods for separating, extracting and refining hydrocarbons from a hydrocarbon matrix, such as oil sand without addition of a polar liquid such as water, or with the addition of relatively small amounts of polar liquids.

Also needed are methods for separating, refining and extracting hydrocarbons from oil formations in situ, that is, without mining or removal of the oil from the subsurface, and without the addition of a polar liquid like water, or adding relatively small amounts of polar liquids. What is also needed is a non-polar ultrasonic media which can be used for separating, extracting or refining of hydrocarbons.

SUMMARY OF THE INVENTION

The present invention relates to the use of ultrasonics and non-polar substances, to recover hydrocarbons, including bitumen, from a hydrocarbon matrix such as those found in oil sands both in situ and in formation. The methods of the present invention can be carried out without the addition or requirement of water. The methods of the present invention can be carried out in the absence of oxygen. The methods of the present invention may be used in various applications including well stimulation, well cleaning, extraction of bitumen and hydrocarbons from an underground formation both shallow and deep, and tailing pond separation. This technology can be used both in new and existing wells.

As such, in one embodiment the present invention provides for a method of extracting hydrocarbons from a hydrocarbon matrix, characterized in that said method comprises: (a) contacting the matrix with a non-polar substance, without addition of a polar fluid, to create a mixture, (b) subjecting the mixture to ultrasonic vibrations, and (c) extracting the hydrocarbons from the ultrasonicated mixture.

In one embodiment the present invention provides for an in situ method of extracting hydrocarbons from an oil formation, characterized in that said method comprises: (a) disposing a non-polar substance, without addition of a polar fluid, into the oil formation, (b) subjecting the oil formation having the non-polar substance to ultrasonic vibrations, and (c) extracting the hydrocarbons from the oil formation.

In one embodiment the present invention provides for a method of separating hydrocarbons from a hydrocarbon matrix, characterized in that said method comprises: (a) contacting the hydrocarbon matrix with a non-polar substance, without addition of a polar fluid, to create a mixture, and (b) subjecting the mixture to ultrasonic vibrations, thereby separating the hydrocarbons from the hydrocarbon matrix.

In one embodiment the present invention provides for an in situ method of separating hydrocarbons from a hydrocarbon matrix in an oil formation, characterized in that said method comprises: (a) disposing a non-polar substance, without addition of a polar fluid, into the oil formation, and (b) subjecting the oil formation having the non-polar substance to ultrasonic vibrations, thereby separating in situ the hydrocarbons from the hydrocarbon matrix in the oil sand formation.

In one embodiment the present invention provides for a method of refining heavy crude oil within a hydrocarbon matrix, characterized in that said method comprises: (a) contacting the hydrocarbon matrix with a non-polar substance, without addition of a polar fluid, to create a mixture, (b) subjecting the mixture to ultrasonic vibrations, and (c) recovering hydrocarbons from the ultrasonicated mixture, whereby the recovered hydrocarbons are refined relative to the heavy crude oils within the hydrocarbon matrix.

In one embodiment the present invention provides for an in situ method of refining heavy crude oil in an oil formation, characterized in that said method comprises: (a) disposing a non-polar substance, without addition of a polar fluid, into the oil formation, (b) subjecting the oil formation having the non-polar substance to ultrasonic vibrations, and (c) recovering hydrocarbons from the ultrasonicated oil formation, whereby the recovered hydrocarbons are refined relative to the heavy crude oil in the formation.

In one embodiment the present invention provides for a method of treating heavy crude oils, characterized in that said method comprises mixing the heavy crude oils with a non-polar substance, without addition of a polar fluid, to form a mixture, and subjecting the mixture to ultrasonic vibrations.

In one embodiment the present invention provides for an in situ method of processing an oil formation, characterized in that said method comprises: (a) disposing a non-polar substance, without addition of a polar fluid, into the oil formation, and (b) subjecting the oil formation having the non-polar substance to ultrasonic vibrations.

In another embodiment the present invention relates to an ultrasonic medium, characterized in that said ultrasonic medium comprises a non-polar substance and in that said ultrasonic medium is free of polar fluids, the ultrasonic medium being capable of forming a mixture with a hydrocarbon matrix and of dissolving hydrocarbons within the hydrocarbon matrix, whereby the hydrocarbons are substantially separated from the hydrocarbon matrix when the mixture is subjected to ultrasonic vibrations.

BRIEF DESCRIPTION OF THE DRAWINGS

The present invention will become more fully understood from the detailed description given herein and from the accompanying drawings, which are given by way of illustration only and do not limit the intended scope of the invention.

FIG. 2 is a boiling point table of an oil sand sample processed in accordance to one embodiment of the present invention.

FIG. 3 is a cut point table of an oil sand sample processed in accordance to one embodiment of the present invention.

FIG. 4 are photographs of oil sand matrices. 4*a*: Photograph of raw untreated oil sand. 4*b*: Photograph of oil sand treated with a small amount of xylene. Very little difference is observed between FIGS. 4*a* and 4*b*.

FIG. 5 is a photograph of a glass of oil sand or oil sand after ultrasonic treatment with xylene, mixed with water and left to sit for two months. Note the separation of sand and bitumen.

FIG. 8 is a $C_{30+}$ analysis of the bitumen in an oil sand matrix.

FIG. 11 is a $C_{30+}$ analysis of fracturing fluid.

DETAILED DESCRIPTION OF THE INVENTION

Figure 1:
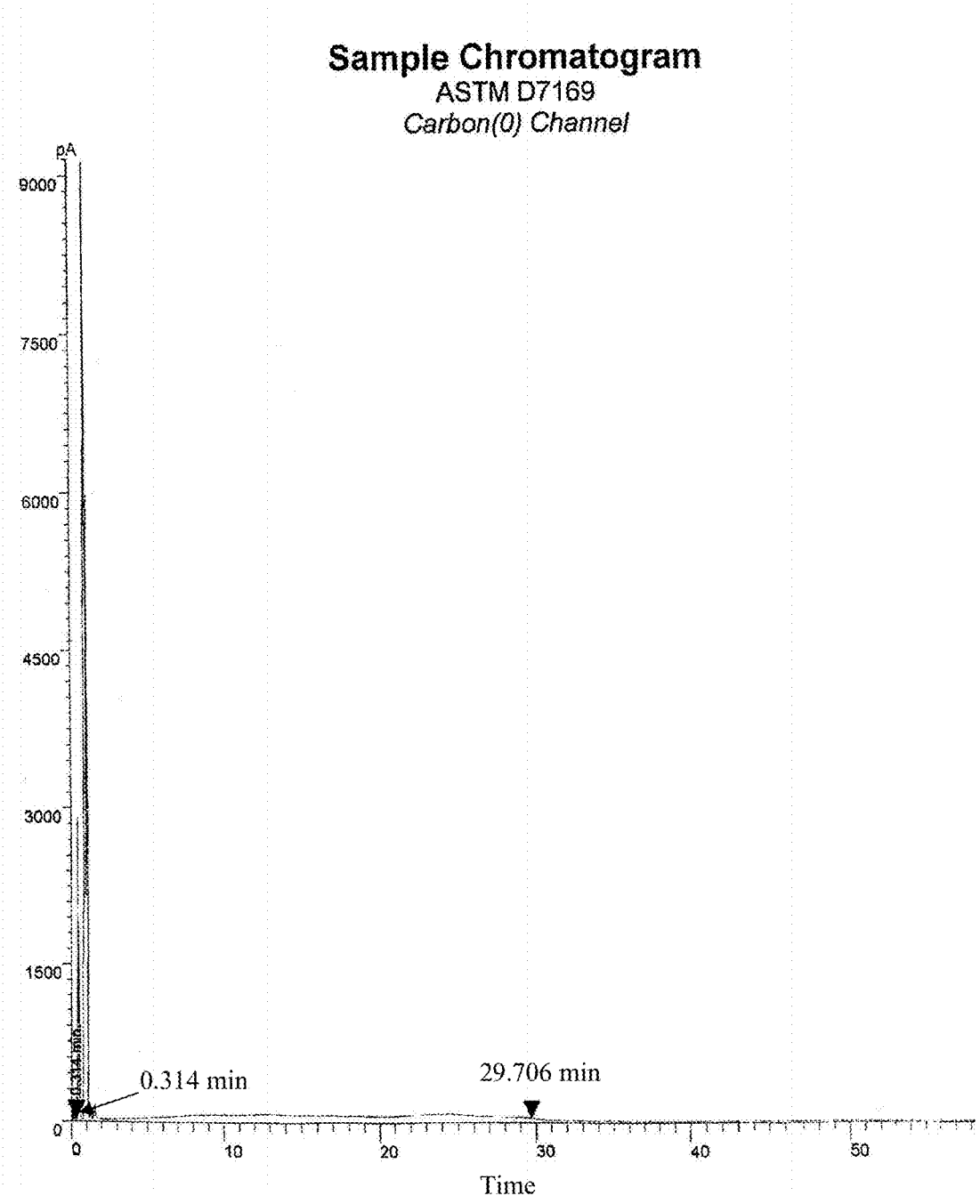
FIG. 1 is a graph showing a sample chromatogram of an ultrasonicated mixture of oil sand and a non-polar substance in accordance with one embodiment of the present invention.

Unless defined otherwise, all technical and scientific terms used herein have the same meaning as commonly understood by one of ordinary skill in the art to which this invention belongs. Also, unless indicated otherwise, except within the claims, the use of "or" includes "and" and vice-versa. Non-limiting terms are not to be construed as limiting unless expressly stated or the context clearly indicates otherwise (for example "including", "having" and "comprising" typically indicate "including without limitation"). Singular forms including in the claims such as "a", "an" and "the" include the plural reference unless expressly stated otherwise.

Overview

The methods of the present invention are based on in situ or on surface separation, cracking or refining, and extraction or recovery of hydrocarbons from oil deposits. The processes of the present invention may be capable of producing high yields of hydrocarbons, including bitumen.

By "heavy crude oils" is meant crude oil which do not flow easily or not flow at all (i.e. solid). As such, the term "heavy crude oil" as used in this document includes liquid petroleum with an API gravity below about 20°, liquid petroleum with API gravity below about 10.0° API (i.e. with a density greater than 1000 kg/m$^3$). For the purpose of this document, the term "heavy crude oil" includes bitumen, which may be present as a solid and does not flow at ambient conditions. "API gravity" stands for American Petroleum Institute gravity, which is a measure of how heavy or light a type of petroleum is compared to water.

By "in situ" it is meant that the process takes place at the crude oil deposit and without extracting the crude oil from the crude oil deposit.

The term "hydrocarbon matrix" as used in this document refers to a raw or crude mixture obtained from an oil formation, and which includes crude oil and a substrate. The crude oil may include heavy crude oil. The substrate may be a mixture of sand, sandstone, sedimentary rocks, clays, and so forth. Examples of hydrocarbon matrices include oil sand in an oil formation or a sample of oil sand.

The term "media" as used in this document refers to substances capable of transferring ultrasonic energy from an ultrasonic transducer.

The term "recovery" as used in this documents means techniques for extracting crude oil from an oil deposit.

The term "refinement" as used in this document refers to the breakdown of long-chain hydrocarbons into short ones.

The methods of the present invention may not require the addition of a polar solution such as water. It should be understood, however, that water may already be present in the hydrocarbon matrix and/or oil formation. For the methods of the present invention it may not be necessary to remove all of the water already present in the hydrocarbon matrix or oil formation. As such, the methods of the present invention do not require adding water or the addition of substantial amounts of water or presence of water, but water may nevertheless be inherently present in the hydrocarbon matrix or oil formation.

Hydrocarbon Separation

In one embodiment, the present invention relates to the separation of hydrocarbons, such as bitumen, from a hydrocarbon matrix, such as oil sand.

Oil sand, which may also be referred to in the literature as tar sand, may be fed into a vessel. Any non-polar substance capable of acting as both a solvent and medium for an ultrasonic transducer may then be poured into the vessel. A polar fluid such as water does not need to be added into the vessel. The non-polar substance may be any suitable non-polar compound capable of acting as a solvent for the hydrocarbons in the hydrocarbon matrix. One or more non-polar substances may be provided. Preferably, the non-polar substance includes non-cyclic, short chain alkanes such as pentane, hexane, heptane or octane. Other suitable non-polar substances include benzene, toluene xylene, butane, gasoline, fracturing ("frac") fluid, reformate compositions or any combination thereof. The mixture oil sand/non-polar substance may then be exposed to ultrasonic vibrations for a sufficient amount of time. From about 1 kHz to about 80 kHz of ultrasonic vibration may be used to ultrasonically stimulate the mixture. However, a person of ordinary skill in the art may understand that less than 1 kHz or more than 80 kHz may be used. The bitumen and sand may then start to separate into different faces. The bitumen may then be withdrawn from the vessel. The withdrawn bitumen may then be processed to remove any sand or solvent leftover by any known methods, including centrifuging. The separated bitumen may then be sent for further upgrading and distilling.

The present invention may also relate to in situ separation of hydrocarbons from an oil formation. The in situ separation method may include disposing a non-polar substance, without addition of a polar fluid, into the oil formation, and subjecting the oil formation having the non-polar substance to ultrasonic vibrations, thereby substantially separating in situ the hydrocarbons from the hydrocarbon matrix in the oil sand formation.

Hydrocarbon Extraction

In one embodiment the present invention describes in situ and on surface methods of extracting hydrocarbons from a heavy oil formation, such as an oil sand deposit. The in situ method of extracting hydrocarbons from an oil formation may start by disposing a non-polar substance into the formation. For deep extraction, a bore or well may be made in the oil deposit, and the non-polar fluid may be disposed into the bore. The non-polar substance may be capable of separating or removing the hydrocarbon from the matrix in the formation. The method may continue by subjecting the formation to ultrasonic vibrations, and extracting the hydrocarbon from the bore in the formation. The extracted hydrocarbons may then be sent for further processing and or upgrading. The method may be performed without the addition of water.

Figure 10:
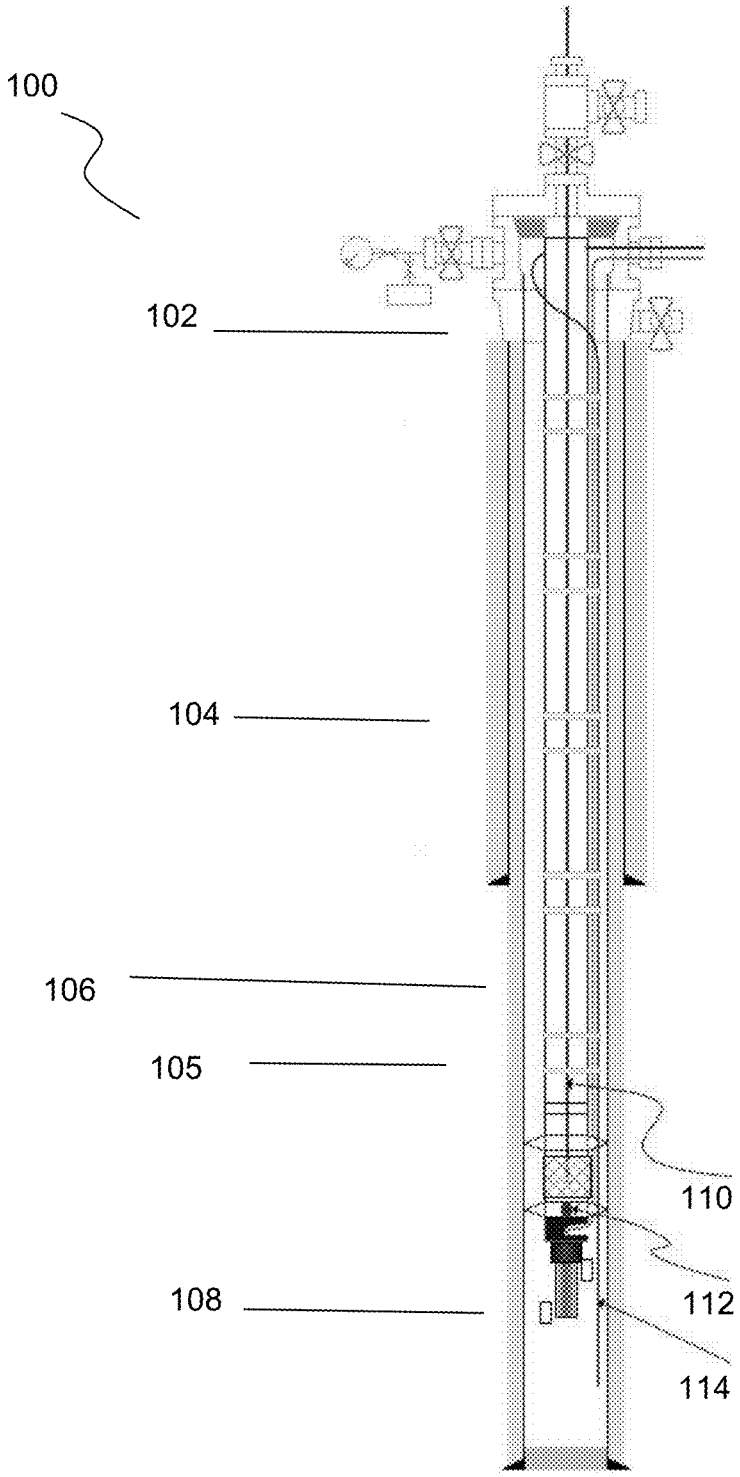
FIG. 10 is a graph illustrating a well bore diagram.

Wells into the formation may be encased as illustrated in FIG. 10. The casing may include one or more perforations, especially in horizontal wells, deep into the oil deposits, which may allow the flow of oil into the well. However, a horizontal well may not be necessary for the methods of the present invention. Preferably, for the in situ methods described in the present invention, the well casing includes one or more perforations into the oil formation.

A non-polar substance capable of acting as a solvent for the hydrocarbons in the oil formation may then be poured into the well. The non-polar substance may be any suitable non-polar compound capable of acting as a solvent for the hydrocarbons in the oil formation. The non-polar substance may also be provided as a non-polar mixture comprising suitable non-polar compounds. Preferably, a non-cyclic hydrocarbon such as pentane, hexane, heptane or octane may be used as the non-polar substance. Other non-polar substances may include solvents such as benzene, toluene xylene, butane, gasoline, frac fluid, reformate compositions or any combination thereof. Addition of water is not required for the extraction methods of the present invention.

An ultrasonic transducer may then be brought into the well and may contact with the non-polar substance which has been poured into the well. From about 1 kHz to about 80 kHz of ultrasonic vibration may be used. However, a person of ordinary skill in the art may understand that less than 1 kHz or more than 80 kHz may be used. When the ultrasonic transducer is turned on, the vibrations in the non-polar solvent may turn the liquid into an ultrasonic media which may dissolve the heavy crude oil in the oil deposit. The dissolved heavy crude oil may in turn create even more ultrasonic media from the non-polar substance/crude oil mixture which continues to spread further into the matrix of the oil deposit. Furthermore, heat may be generated from this method as a result of exothermic reactions within the dissolving process. The solvents and ultrasonic vibrations may contribute in reducing the viscosity of the heavy crude oil which may flow through the perforations and then be pumped out of the well, thereby extracting the hydrocarbons (such as bitumen present in oil sands) in situ from the oil deposit.

Heavy Crude Oil Refinement

In one embodiment, the present application relates to on surface or in situ cracking or refinement of heavy crude oil. The heavy crude oil refinement methods of the present invention may be based on the behaviour of hydrogen and alkane re-composition under the influence of ultrasound.

Figure 6:
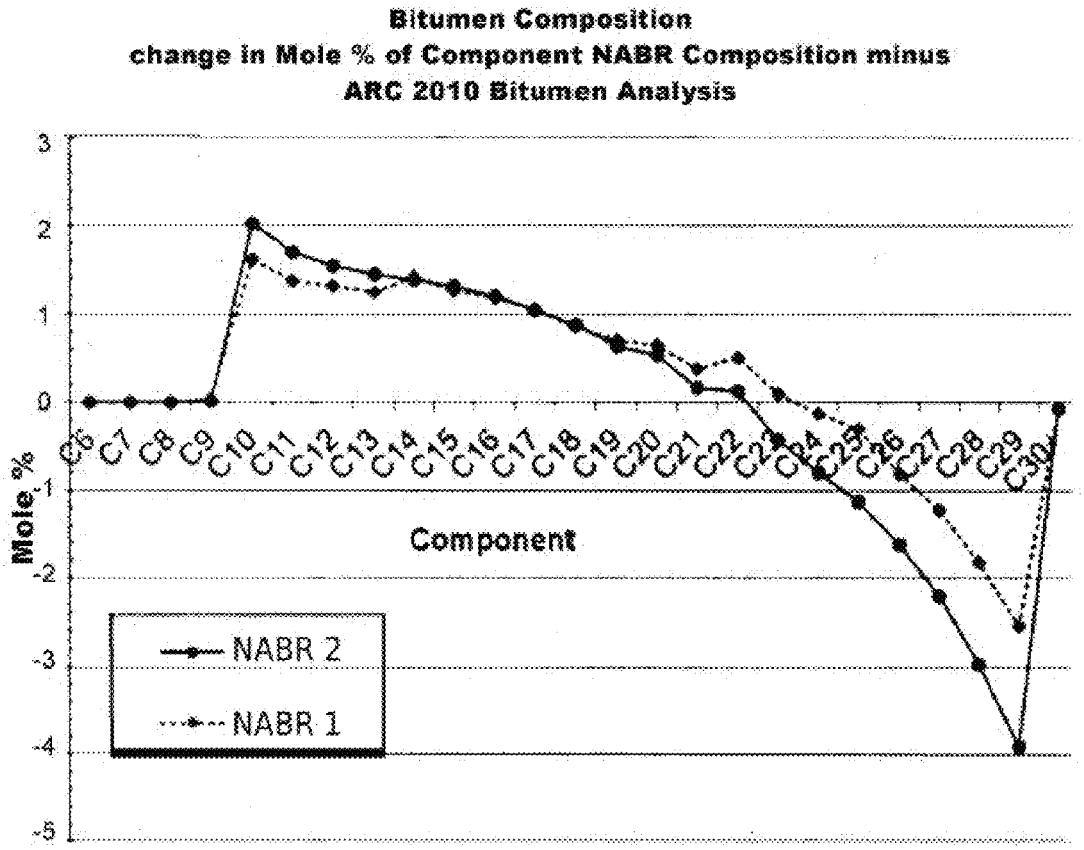
FIG. 6 is a graph illustrating differential analysis between initial control bitumen and processed bitumen in accordance to one embodiment of the present invention. Green NABR 1 following 30 minutes, Green NABR 2 following 2 hrs. The "Green NABR" heading is an anachronism for Green Non-Aqueous Bitumen Recovery, the name of the inventor's project to investigate the effects of ultrasonics on hydrocarbons, and the labelled ARC 2010 is the oil sand provided by the Alberta Research Council and analysed by Core Lab in Calgary.

The inventor discovered that the concentration of longer alkane molecules in an oil sand sample when subjected to ultrasonic stimulation delivered through a sonic media made of a non-polar substance capable of acting as a hydrocarbon solvent and without added polar fluid such as water, may be substantially reduced while the concentration of shorter alkane molecules, or light ends, may be subsequently elevated (for example see FIG. 6). The use of ultrasonics without the addition of water reduces the viscosity of the crude oil by reducing the length of the hydrocarbons in the crude oil matrix. Lower viscosity may allow for pumpable oil, easier extraction of the oil from the deposit, and facilitate transportation to an upgrading processing centre without use of steam, heat and other high cost processes.

The refinement process of the present invention may be in situ or on the surface.

In situ refinement may start by disposing a non-polar substance capable of acting as both a hydrocarbon solvent and medium for an ultrasonic transducer into a well so as to reach the oil bed. The non-polar substance may be any suitable non-polar compound capable of acting as a solvent for the hydrocarbons in the oil formation. The non-polar substance may also be provided as a non-polar mixture comprising suitable non-polar compounds. The non-polar substance may be any suitable non-polar compound, preferably a hydrocarbon solvent having less carbon atoms than the hydrocarbons in the crude oil to be refined. Preferably, the non-polar compound includes non-cyclic, short chain alkanes such as pentane, hexane, heptane or octane. Other non-polar substances may include solvents such as benzene, toluene xylene, butane, gasoline, frac fluid, reformate compositions or any combination thereof.

An ultrasonic transducer may then be brought into the well for contact with the non-polar hydrocarbon solvent which has been poured into the well. From about 1 kHz to about 80 kHz of ultrasonic vibration may be used to ultrasonically stimulate the mixture of hydrocarbon solvent with oil in the deposit. However, a person of ordinary skill in the art may understand that less than 1 kHz or more than 80 kHz may be used. When the ultrasonic transducer is turned on, the vibrations in the non-polar substance may turn the liquid into an ultrasonic medium which may dissolve the crude oil in the deposit. The dissolved crude oil may in turn become ultrasonic media which continues to spread further into the matrix of the oil deposit. Furthermore, heat may be generated from this method as a result of exothermic reactions within the dissolving process. The non-polar solvent introduced in the oil formation and the ultrasonic vibrations may contribute in reducing the viscosity of the crude oil. The oil may then be pumped out of the well. The oil is thereby extracted in situ in a refined form relative to the crude oil in the crude oil deposit.

Unlike other heavy crude oils, bitumen found in oil sands may be found in a substantially solid form. As a solid, bitumen has a higher attenuation coefficient relative to fluid crude oil. As such, sound waves may attenuate through it. The attenuation coefficient of the fluid solution created during the solvent cracking process, however, will be lower than the attenuation coefficient of the bitumen. As more bitumen is dissolved, more media is available for the transducer, thereby enhancing the overall cracking process of the bitumen.

The resultant concentration of lighter ends of the hydrocarbon species in the extracted oil may depend on the non-polar substance used in the methods of the present invention. By way of example, the inventor have demonstrated that using a composition having pentane as the ultrasonic media for refining crude oil may result in peaks of $C_{15}$, $C_{17}$, $C_{19}$, $C_{21}$ and $C_{24}$ (see FIG. 7), and using a composition having xylene as the ultrasonic media may result in peaks $C_{10}$ (see FIG. 6).

In one embodiment, the present invention describes also a method of refining crude oil from a hydrocarbon matrix already extracted from an oil deposit (i.e. on surface). The matrix may be mixed in a vessel with a non-polar substance or with a mixture of non-polar substances and without having to add water. The vessel may then be gas-sealed. The mixture in the sealed container may then be subjected to ultrasonic vibrations. After exposure to the ultrasonic vibrations for a sufficient period of time, the hydrocarbons in the container may then be withdrawn in a refined form.

The inventor discovered that when heavy crude oils such as bitumen is placed in combination with an alkane such as pentane in an open ultrasonic bath, and the bath is subjected to ultrasonic vibrations, the resultant mixture actively bubbles giving off gasses. Since pentane has a low vapour pressure, much of the gas given off may be pentane vapour. The inventor further discovered that if these pentane gasses were captured and run through a tube submersed in cold water to condense pentane vapour, an abundance of hydrogen may be found in the resultant gases. If this hydrogen is not allowed to escape (for example by performing the method within a gas-sealed container), then the bitumen in the pentane/bitumen ultrasonically stimulated matrix may be refined into higher concentrations of lighter ends and a process equivalent to cracking has occurred.

The degree of refinement of crude oils according to the methods of the present invention may depend on the amount of time the crude oil is subjected to ultrasonic treatment. As illustrated in FIG. 6, more refinement of crude oil may be obtained with longer ultrasound treatment.

Water-Free Transducer Media

The in situ and on surface methods of the present invention may be performed using non-polar ultrasonic transducer media without having to add polar fluids such as water.

Surprisingly, the inventor found that polar fluids like water may negatively affect the generation of further hydrocarbon solvent liquids necessary to set off the chain reaction resulting in the cracking and refining of crude oils.

Water is a known medium for efficient attenuation of ultrasonic waves. However, water is not a hydrogen donor which may be necessary for the cracking process. As such, water may become a deterrent to the overall cracking process.

The separation, refinement and extraction methods of the present invention may be performed without the addition of polar substances such as water. As such the present invention relates also to a water-free ultrasonic media which may also be useful for separating hydrocarbons, such as bitumen, from a matrix sample, such as an oil sand sample, in situ or ex situ. The water-free, ultrasonic media of the present invention may also be useful for refining crude oil and heavy oil. Water-free ultrasonic media of the present invention may include a non-polar substance capable of acting as an oil solvent, or may be a mixture of suitable non-polar substances. Preferably, the non-polar substance may be a non-cyclic hydrocarbon such as pentane. Other non-polar fluid substances, or mixtures thereof, which may be used as water-free ultrasonic media for separating hydrocarbons like bitumen from a hydrocarbon matrix like sand, or for refining crude oil and heavy oil may include solvents such as benzene, toluene xylene, butane, gasoline, frac fluid, reformate compositions or any combination thereof.

The inventor further discovered that substances containing oxygen as part of their molecular structure may not be efficient solvents due to the strong molecular bonds common in oxides. As such, the present invention in one embodiment relates also to oxygen-free ultrasonic media.

The inventor further discovered that the refinement and extraction methods of the present invention may be performed in the absence of oxygen gas. Crude oil formations may be considered heat sinks which may be capable of absorbing the heat produced by the ultrasonic waves, and there may be a relatively lower danger of generating explosions from heat, pressure or chemical reaction. This may be particularly true in the absence of oxygen.

To ensure substantial absence of gaseous oxygen, an oil well may be capped with nitrogen under pressure. One may also flush the well with a liquid, such as liquid propane, which may be used to cap the well at the end of the methods in order to prevent the possibility of explosion or combustion.

Advantages of the present invention include:

1. Separation and extraction processes which overcome the difficulties and problems of known prior art processes, which may include economic and environmental advantages.
2. Separation and extraction processes in which no water is needed.
3. In situ bitumen recovery which does not consume large quantities of natural gas to produce steam in order to heat the reservoir.
4. In situ bitumen recovery that does not require any external addition of heat from any source.
5. In situ bitumen recovery that avoids contaminating the bitumen with water and therefore avoids the many problems of oil-water emulsion separation common to steamed bitumen processes once the fluids reach surface.
6. In situ bitumen recovery that does not expose the sensitive clays in the sub-surface formation to damaging fluids such as water which is known to cause clay swelling and subsequent narrowing of the reservoir pore spaces.
7. In situ bitumen recovery that allows the bitumen to be produced to surface at sufficient temperature to have flow characteristics, but without the extreme heating of steam processes which waste energy in the reservoir.
8. In situ bitumen recovery that allows the bitumen to be produced to surface in much shorter time frames.
9. In situ bitumen recovery that allows the bitumen to remain in situ after treatment without the bitumen returning to its original form thus enabling control over extraction timing.
10. In situ bitumen recovery which avoids the prolonged steam and heat exposure of the bitumen in the reservoir. In conventional SAGD or CSS processes, this severe prolonged heating in the presence of water causes aquathermolysis, which is the process by which bitumen reservoirs 'sour' over time, producing H2S gas. The proposed invention avoids the use of water and therefore not allow progression of the aquathermolysis.
11. Separation and extraction processes which completely separates all organic materials and/or hydrocarbons such as bitumen, oils and tars from emulsions, soils, earth and sands, without mining or removal of the deposit from the sub-surface.
12. Separation and extraction processes which alters the chemical composition of the bitumen by breaking down long molecular chains of hydrocarbon into smaller chains without mining or removal of the deposit from the sub-surface.

The above disclosure generally describes the present invention. A more complete understanding can be obtained by reference to the following specific Examples. These Examples are described solely for purposes of illustration and are not intended to limit the scope of the invention. Changes in form and substitution of equivalents are contemplated as circumstances may suggest or render expedient. Although specific terms have been employed herein, such terms are intended in a descriptive sense and not for purposes of limitation.

EXAMPLES

The examples are described for the purposes of illustration and are not intended to limit the scope of the invention.

Example 1

Bench Testing

Materials

A sealed bucket of medium grade oil sand was obtained from the Alberta Research Council and stored for three months at ambient temperature.

An ultrasonic bath, a Whaledent Biosonic UC1-110 operating at 55 KHz, was used to test the effects of ultrasonics on oil sand.

Chemical analysis were done at Core Lab, Calgary, Alberta. An Agilent™ HP™ 6890 gas chromatograph was used for the C30+ analysis using ChemStation™ chromatography data system.

Experiment 1

Four small jars of oil sand were placed in the ultrasonic bath with the addition of half (½) oz of four different solvents as described in Table 1. A fifth jar of oil sand was also used, which had no solvent (control). Following two weeks in the ultrasonic bath, the jars were removed from the bath and some of their contents removed and set aside to dry to obtain a qualitative analysis of the effectiveness of each solvent. The masses of the resultant contents were measured using a weigh scale. The reduction of mass of each of these mixtures, as illustrated in Table 1, was believed to be due to evaporation of short carbon chains, such as C-1 to about C-6. In the case of water, simple evaporation was believed to be the cause of loss of mass.

Table 1 sets out the experiment and results (weight of jar and lid: 120 gm):

TABLE 1

| Sample # | Mass of oil sand and jar (gm) | Solvent used | Amount of solvent (oz) | Mass of. resultant mixture used for drying experiment | Mass after one week | Mass loss (gm) |
|---|---|---|---|---|---|---|
| 0 | 240 | None | | 20 | 20 | 0 |
| 1 | 240 | Water | 0.5 | 25 | 21 | 4 |
| 2 | 240 | Xylene | 0.5 | 31 | 20 | 11 |
| 3 | 240 | Gasoline | 0.5 | 30 | 26 | 4 |
| 4 | 310 | Acetone | 0.5 | 26 | 26 | 0 |

To test whether short chains were being produced by the ultrasonic treatment of the oil sand/non-polar solvent mixture, the bath basket of the ultrasonic bath machine was half filled with water and a glass containing about half a cup of oil sand was placed in the bath. 0.5 oz of xylene (Number 11 paint thinner) was added to the glass of oil sand. (Note: in none of the experiments described herein was water added into the glass.) The ultrasound machine was turned on at about 55 kHz. The oil sand became wetted throughout by the xylene as soon as the machine was turned on. After two hours, the machine was turned off, the wetted sand was thoroughly stirred and a small sample of liquid was extracted. This sample (about 0.2 grams) was analyzed by the Petroleum Engineering Department at the University of Calgary. FIG. 1 is a chromatogram of the sample showing the vapourization off the sample. FIG. 1 shows how much of the alkanes in the substance were boiled off as a result of the distillation process as it went through the analysis machine. FIG. 1 illustrates that minimal alkanes went through the analysis machine. FIG. 2 is a boiling point table showing the boiling range distribution of the analyzed sample, which provides insights into the composition of the sample, and shows that 91.46% of the sample boiled at 744.4 degrees centigrade. FIG. 3 represents a segment of the results, known as a Cutting Point Table. As shown in FIG. 3 the analyzed sample contains about 42% of C8, C9 species, about 4.5% of C7, C8 species and less than 1% for every other carbon chain length species. Notably, the sample was shown to contain 0% of C5, C6 species and almost 0% of C6, c7 species, which may have evaporated.

Experiment 2

440 g of oil sand was mixed with 1 oz of xylene. The mixture was placed in a sonic bath for 2 hours. Following this, the mixture was placed in a blender and a half (½) cup of water added. The blender was turned on for a few moments ensuring a thorough agitation. The resultant mass was placed in a glass tumbler and set aside for 2 months.

FIG. 4 are photographs of oil sand. FIG. 4*a* is a photograph of raw untreated oil sand. FIG. 4*b* is a photograph of oil sand mixed with a small amount, about half (½) oz., of xylene. Very little difference is observed between FIGS. 4*a* and 5*b*.

FIG. 5 is a photograph of a jar of oil sand with a small amount of xylene added and ultrasonically treated. The jar was left to sit for two months. Note the separation of sand 4 and bitumen 2.

Example 2

Bench Testing

Materials

Sealed bucket of high grade oil sand (bitumen) sample was obtained from the Alberta Research Council.

A Whaledent Biosonic ultrasonic bath rated at 55 KHz. was provided by Western Ultrasonics.

The raw and treated Alberta Research Council bitumen samples were analysed for carbon number mole percent composition at the Core Lab in Calgary.

Methods 1. 122 g of oil sand was mixed with 7 g of pentane for initial test. The mixture was sonicated in a bath at about 55 KHz. Smoke and vapours formed immediately. Liquids were gone in about one minute with dry clump of oil send left with small nodules of mobile granules at the bottom of the ultrasonic cleaning tank.

2. Added 100 ml pentane, 46 g, for about 5 minutes. Again, instant reaction and vaporization occurred. Temperature climbed to 25 degrees in five minutes and experiment stopped for safety reasons.

3. It was noted that bubbles and "activity" continued with the pentane-bitumen mix for about 5 to 10 minutes following the machine being shut off.

4. The mixture was placed in a glass jar and set in an ultrasonic water bath for about 2 hours. The ultrasonicated product looked like a wet sand.

5. The mixture was a consistent matrix appearing like wet sand with an apparent constant wetting.

6. Differential molar percentages were determined by subtracting resultants from the chemical analysis of the raw oil sand (step 1) and presented in FIG. 7.

Results

Figure 7:
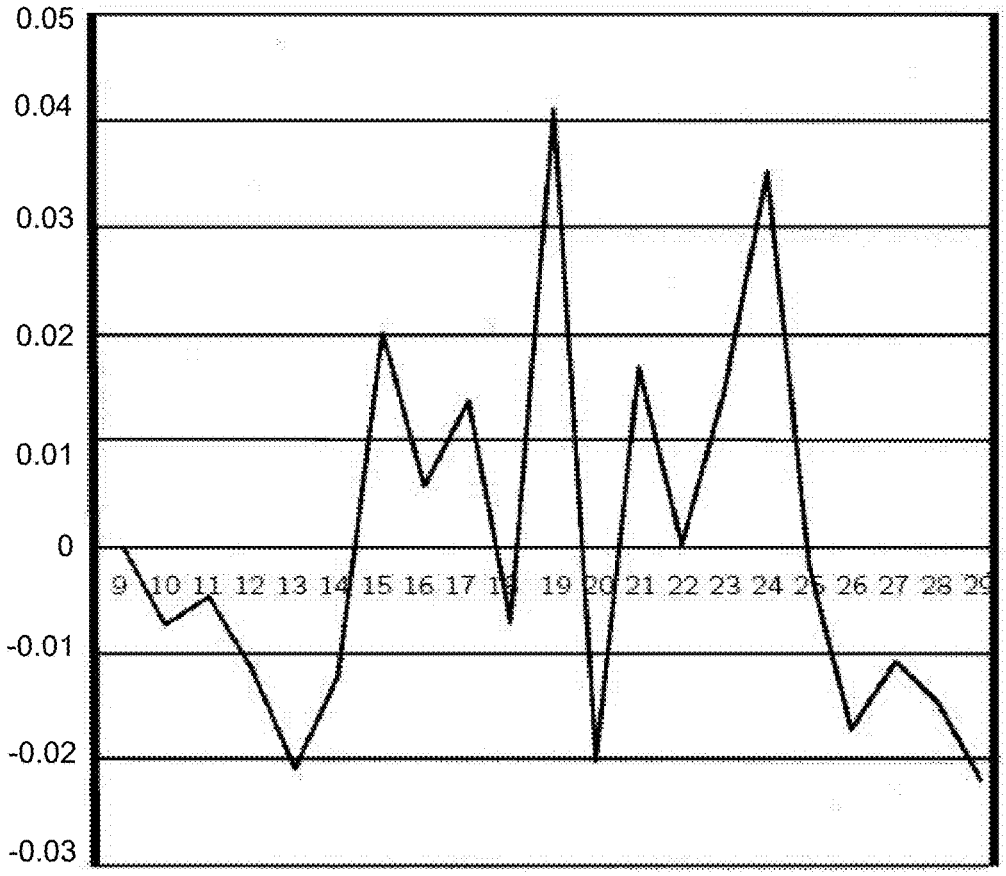
FIG. 7 is a graph illustrating differential analysis between initial control bitumen and processed bitumen in accordance to one embodiment of the present invention.

FIG. 7 illustrates that the method provided herein resulted in the refinement of the crude oil originally provided (see FIG. 8 for $C_{30+}$ analysis of the raw oil sand sample). The resultant treated mixtures comprise more C15, C17, C19, C21 and C24 alkane species than the original, untreated bitumen. The refinement of crude oil may also depend on the amount of time the crude oil is subjected to ultrasonic treatment.

Example 3

Bench Testing

Materials

Sealed bucket of high grade oil sand (bitumen) sample was obtained from the Alberta Research Council.

A Whaledent Biosonic ultrasonic bath rated at 55 KHz. was provided by Western Ultrasonics.

The raw and treated Alberta Research Council bitumen samples were analysed for carbon number mole percent composition at the Core Lab in Calgary.

Method

1. One sample of raw oil sand was sent for chemical analysis.

2. Approximately 4.5 Kg of oil sand was packed into the ultrasonic bath leaving a 0.5 liter space in the middle section of the packed oil sand. Approximately 0.5 liter of xylene was added to the middle section of the oil sand and the bath was turned on for 30 minutes. The resultant mixture was extracted from the bath and sent for the carbon analysis. This sample was labelled "NABR 1".

3. The experiment was repeated with the bath being turned on for 2 hours before stopping the experiment, extracting the resultant mixture and chemically analyzing it as in step 2. This sample was labelled "NABR 2".

4. Resultant molar percentages in the mixtures NABR 1 and NABR 2 were determined for alkanes up to C29. C30 and beyond were presented as a single alkane composite.

5. Differential molar percentages were determined by subtracting NABR 1 and NABR 2 resultants from the chemical analysis of the raw oil sand (step 1) and presented in FIG. 6.

Results

FIG. 8 illustrates a $C_{30+}$ analysis of the raw oil sand sample. FIG. 6 illustrates the method provided herein resulted in the refinement of the crude oil originally provided. The resultant treated mixtures comprise more C10 to C23 alkane species than the original, untreated bitumen sample. In particular, the resultant mixtures comprise an elevated Mol percentage of C10 and C11 alkane species than the original bitumen. The refinement of crude oil may also depend on the amount of time the crude oil is subjected to ultrasonic treatment. As illustrated in FIG. 6, NABR 2 (2 hours) shows more refinement of crude oil than NABR 1 (30 minutes), as such more refinement may be obtained with longer ultrasound treatment.

General Conclusions from the Three Bench Testing

Our observations from the experimentation of hydrocarbon solvents in oil sand material and the presence of ultrasonics are:

1. Water does not enhance and may inhibit the ultrasonic process as it seems to cause little or no permanent change to the oil sand matrix.

2. High heat is created, therefore increasing the chances of combustion.

3. The lowering of viscosity of oil from oil sand material and the liquefaction of the oil sand matrix appears to be extremely rapid; approximately a few seconds with the small volumes used in the bench tests.

4. There is evidence that a chemical reaction has occurred within the oil sand matrix producing more lightened hydrocarbons. This was observed as the liquefaction process was permanent in the presence of certain hydrocarbons and not observed with water as the solvent. Chemical analysis was also done to indicate a permanent change in compound length.

5. Sand separated from the matrix following ultrasonic treatment using a hydrocarbon substance and without the addition of water.

6. Following the ultrasonic treatment the oil sand matrix sustains a permanent change that maintains a lowered viscosity both at room temperature and below as substances were refrigerated. This may be a result of not using water, as well as proof of the chemical compound change in the cracking of high-end hydrocarbons.

7. The increase in pressure is believed to have come from boiling pentane during one of the experiments. Pentane has a very low flashpoint. A chemical analysis was done on the gases produced during the experiment and showed it was mainly pentane in a gaseous state. It is determined that this boiling is not required in our process.

8. There was enough evidence of cracking, and lowered viscosity with minimal cost and time to produce results that it was recommended to move to a field test in an in situ oil sand recovery well.

Example 4

In Situ Field Testing

Test Well Location

The well used in this in situ field testing may be referred to as the Five Wolves Well as part of the Green NABR pilot program. This well is located in Northern Alberta, Canada. The reservoir information indicates 18 m of bitumen payload at approximately 420 m depth from surface. The formation from top to bottom is McMurray, 18 m bitumen, McMurray, Paleo/Limestone. The well as a 7" surface casing of cement and 4.5" of production casing.

A cross section of the well 100 is illustrated in FIG. 10. All reference numbers provided herein below relate to the elements of FIG. 10. The schematic of the well 100 includes a casing bowl 102 of about 179 mm, a concrete casing 104 of about 178 mm, which landed at about 234 m, a production casing 105 of about 114 mm, which landed at about 455 m, and tubing 106 of about 60 mm EUE. A total of 4 casing windows 108 were perforated in the production casing 105. The top of the first window being at about 428.6 m and the bottom of the last window being at about 429.7 m. The well also includes diagnostic instrumentation such as fiber optic DAS 110 (continuous to 425 m, inside tubing 106), pressure/temperature, strain gauge recorder 112 (427 m, inside tubing 106) and fiber optic DTS 114 (continuous to 435 m, outside of tubing 106).

All necessary arrangements were made for meeting Alberta's Energy Resources and Conservation Board (ERCB) requirements for use of this well for the Green NABR pilot program.

Equipment & Materials

Transducer

The production of ultrasonic wave was in the form of a transducer. A transducer was placed downhole as a wireline tool. With reference to FIG. 10, four square sections or windows 108 were cut in the production well casing 105 to expose the bitumen to the pentane and ultrasonic waves. The four windows in two pairs.

Telsonic Ultrasonics™ transducerRS-25-48-8: Transducer size: 2 in diameter; 951 mm length; Power use: 500 volts each @ 3 amps; Produces ultrasonic waves in a cylindrical shape from the transducer.

Cabling and Adapter

The transducer needed to be connected to the 500 m of line cable carrying the power from the surface to the payload section of the well. It was important to build a solid link with the transducer and a lot of effort and design went into experimenting and ensuring the appropriate link for the right cabling.

The cable used in the field testing was a HF-silicone coaxial cable from Telsonic AG™.

Generator

An ECO 2515R Ultrasonics generator from Telsonics Ultrasonics which generated 25 Khz at 500 volts to drive the downhole transducer.

Solvent

The lab tests showed the effect of the ultrasonic was amplified through the use of a solvent in direct contact with the oil sand material in the absence of oxygen-containing substances and water. As such, a key component in the set-up of the pilot project was securing the necessary volume of the appropriate solvent for the downhole test.

14 $m^3$ of pentane were secured for the in situ field test.

Safety

All team members met the necessary safety requirements prior to departure for the site location.

Downhole safety concerns associated with the ultrasonics technique were identified with the high production of heat in the process, 300° C. Other concerns included: high pressure, blowout prevention, flash points, and containment.

Caution/Shut-down alarms were set downhole to be triggered at the following criteria:

1) Pressure at 3000 kPA (Caution); Pressure at 5000 kPA (Shut-Down)

2) Temperature at 160 degrees (Caution); Temperature at 200 degrees (Shut-Down)

On-Site Field Test Plan

The role of the field testing team was to ensure the set-up of the transducer and geophone technology in monitoring the ensuring the success of technique on the larger scale.

Strategy

The plan was to let the transducer run for 2-3 weeks in situ depending on the final start of the project, and the necessary end date based on completion prior to spring.

Aim of the Project

The aim for this pilot project was to test the viability of inserting an ultrasonic transducer of sufficient power into an oil sand payload (in situ).

Goals of the Project

There are two major goals to this pilot project:

i. significantly reduce the viscosity of the payload; and ii. refine hydrocarbons in the payload.

Figure 9:
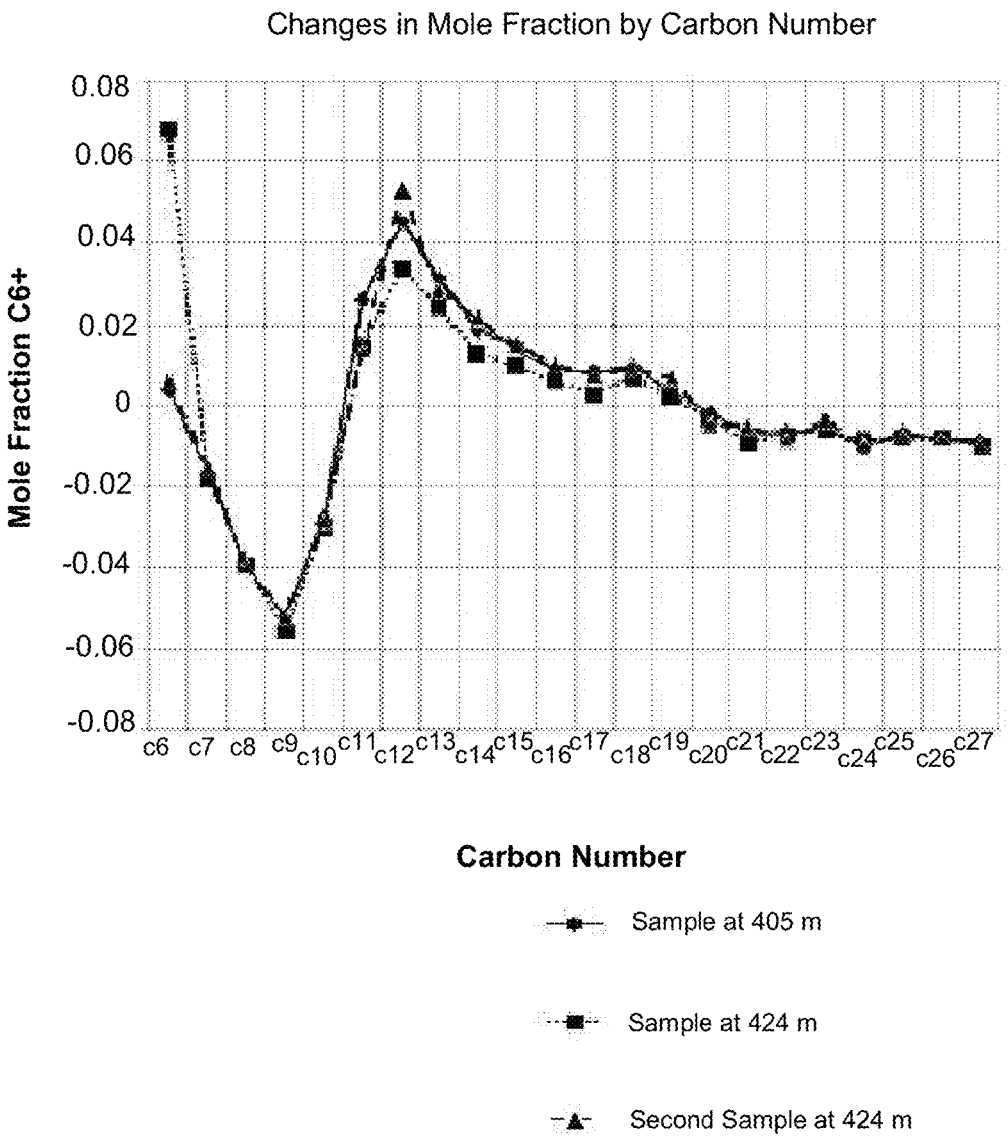
FIG. 9 is a graph illustrating a differential analysis between control bitumen sample obtained from an oil sand deposit and 3 bitumen samples processed in situ in accordance to one embodiment of the present invention and obtained from the same oil sand deposit as the control.

The In Situ Tests i. A wellsite was obtained for testing use.

ii. 3-D seismic before was completed.

iii. A completion design was formed.

iv. Contractors were hired.

v. Materials and equipment were obtained.

vi. The ultrasonic tool was turned on and turned off after 84 continuous hours.

viii. Three down hole samples were obtained: one at 405 m, and two samples at 424 m. The 3 samples were then analysed to study the changes in mole fraction by carbon number. A control sample was obtained from the wellhead prior to the start of the in situ test. The treated and controlled samples were sent for analysis. Analysis was done in a pressure, volume, and temperature (PVT) lab and samples were maintained at downhole pressure and temperatures. The samples were analyzed for C30+ hydrocarbons 11 days after they were collected. Results of the analysis are shown in FIG. 9

Summary for Pilot Project at the Five Wolves Well

From start up to the shut-down of the transducer tool to extract the 3 downhole samples the experiment ran for approximately 84 hours and had a maximum temperature of 16.4 deg C. The surface fluids were mostly clear and changed to a medium brown after two days of the tool being turned on. The pressure of the well slowly dropped from atmospheric to 5 KPa over three days.

The experiment was shut-down seven days into the experiment due to failure of the cable which threatened the integrity and safety of the well. Additional cabling was not purchased as there was not adequate time to secure replacement coaxial cabling prior to the March 15th break-up date at which point no heavy machinery is allowed to be on-site.

The experiment was not pushed past the failure point, but instead was put on hold and the test may be resumed the following winter. As a result, the transducer, cabling, and pressure gauges were left downhole and the well closed for the spring and summer season.

The surface temperature during the experiment ranged from −2 C to −40 C which impacted some of the equipment used such as the pressure gauge and cabling. This suggests that future experiments during the winter should use robust equipment better suited for a range of cold temperatures.

Additional observations are separated into four key categories: technology, logistics, personnel, and other observations.

Technological Observations

A voltage reading of 0.4 V in the shielding of the cable was used to confirm the ultrasound transducer was working through the experiment.

Well Preparation

A graph of the longitudinal cross section of the well is shown in FIG. 10.

Windows were cut in the well in order to facilitate the injected pentane to reach the bitumen bed. This cutting process required the use of water in the well. The ultrasonic and solvent technique to be tested, however, requires that no aqueous solution be added and therefore it was important to remove the excess water from the well before injecting the pentane and starting the transducer. SF-840™ (SynOil™) fracturing fluid was used in the removal process. As a result there was an unknown volume of frac fluid at the bed near the windows. A mixture pentane/frac fluid was assumed to act as the non-polar substance, and used in the chemical analysis. FIG. 11 illustrates an analysis of the frac fluid.

A camera was sent down the well to determine the success of the wall cutting. Visual inspection of the opening was not possible as the bed material had caved into the well likely due to the lower pressure zone in the well itself. Although the visual inspection was not successful, the caving material indicate that the window cuttings were indeed completed and the bed is open to the solvent injected into the well.

Cabling

The team experienced difficulty in attaching the cable to the tubing and lowering it into the well without damaging the cable. As noted above, damaged cable was the reason for stopping the experiment.

Solvent

42 L of pentane was injected in the well through the tubing line that was designed to hold the tool at depth and enable continuous injection as needed during the experiment. As noted in the well preparation there was an initial volume of oil-base frac fluid that was below the injected pentane and which may have acted as an initial non-aqueous solvent in the experiment.

Pressure

Pressure was measured through pressure gauges at downhole locations at the top of the transducer as well as at the wellhead. Battery problems were experienced with pressure instruments, however back-up pressure gauges were available and installed as needed.

There was a loss of pressure data from the tubing pressure gauge.

A pressure difference between the surface and the downhole location was noted during the experiment.

Temperature

Temperature was recorded using a fibre optic cable through the length of the well. Results are available as each point in time and depth for the length of the experiment.

Some specific temperature observations were: temperature increased linearly from surface to the bed depth at 400 m, and a spike was noted at the tool depth when it was turned out. This spike was about 2 degrees higher than the surrounding bed temperature; the transducer tool was initially turned on and off to test the rate of temperature change. The tool cooled within 30 min to the bed temperature; when the tool was turned off after the 84 hours the tool remaining above the original bed temperature for approximately 6 hours. This suggests that the tool created an increase in temperature in a larger volume of bed material that was acting as an insulator in maintaining the temperature of the tool once turned off.

Acoustic Information

An acoustic line was sent down the well for two days of the experiment and data is available for the length of the well from surface to the top of the tool. This information will be analysed to understand the wave lengths and frequencies as they changed with time through the experiment as a potential indication of the volume of the bed that contains the pentane solvent.

Logistics Observations

Materials and equipment must be suitable for very cold weather.

Materials and equipment must be robust to be handled in a rig environment.

Additional Observations

Wildlife: The transducer tool was turned on at the surface to determine the effect of the ultrasonics on wildlife. This test was followed by a visit of a family of five timber wolves.

Once the tool was subsurface no other abnormal wildlife activity was noted.

Safety: Overall the integrity of the experiment with safety concerns was maintained as the test was stopped immediately upon detection of failure of well integrity.

Results and Discussion

This in situ technology works by placing an ultrasonic transducer into an oil well with exposure to a surrounding oil sand matrix, and a hydrocarbon solvent without addition of water and air (oxygen). The absence of air is important in reducing the risk of explosion. The absence of water optimizes the chemical chain reaction that leads to the possibility of a viable commercial process by increasing the scale of cracking of high-end hydrocarbons.

The key elements of how this works and why are explained below.

1. Results—The Chemical Reaction

In situ is an almost 100% efficient process, as there is no other place for the energy to go in the absence of water and air as well the oil sand bed forms an ultrasonic insulator. All of the energy supplied by the ultrasonic transducer goes into the reduction of enthalpy from high-end hydrocarbons to low-end hydrocarbons. As clearly described in FIG. 9, the three samples obtained from the well using the in situ method provided herein resulted in the refinement of the bitumen of the oil sand. FIG. 9 illustrates that the three samples contain more C6 and C12 species than control bitumen obtained before the process started, as well as losses of C9 and hydrocarbons having C20 or longer carbon chains relative to the control sample. In particular, the processed samples include an elevated mole percentage of C6 and C12 alkane species relative to the unprocessed sample of bitumen.

The reduction of long-chain hydrocarbons or alkanes into shorter chains involves a hydrogen debt. Hydrogen has to be supplied from a source external to the bitumen. This is provided by shorter chains within the non-polar solvent. Ultrasonics involves cavitation in which momentary peaks of very high pressure and temperature occur. It is believed that these momentary peaks provide the necessary environment to allow the breakage of bonds in hydrocarbons producing free ions and a hydrogen supply. This is what causes the resulting permanent cracking process.

Bitumen within the formation is at about 12 degrees centigrade and behaves as a solid. Ultrasonic waves attenuate rapidly through solids but rather travel efficiently through a liquid medium. Since hydrocarbon solvents and bitumen form a liquid medium the ultrasonic waves can travel through it. This creates more liquid medium and hydrocarbon solvent as the reaction occurs moving out through the oil sand material. In effect, a "physical/chemical chain reaction" is occurring in the matrix driven by the energy supplied by ultrasonics.

Water is a liquid and acts as a medium for efficient attenuation of ultrasonic waves. However, water has very strong bonds making it nearly impossible to supply free hydrogen ions necessary for cracking. It is also necessary to create a solution of bitumen and solvent for the chemical reaction to occur. Water is unable to create the required bitumen and solvent solution because of its polar property and chemical composition. As such, water becomes a deterrent to the overall cracking process and cannot create the physical/chemical chain reaction. Water also creates a sludge emulsion mixture (not a solution) that indicates a lower viscosity but does not enable the ion exchange that will create a permanent chemical compound change of the bitumen.

Viscosity Reduction

There are many ways one can reduce the viscosity of bitumen in oil sands. This may be necessary for enabling transportation of bitumen from the well to a refinery.

One method may be to use a diluent, such as pentane, which may be mixed with extracted bitumen at the surface to lower the viscosity and enable transportation to a refinery. The use of pentane as a diluent solvent dissolves the bitumen which reduces the viscosity while in solution. However, the use of pentane in diluent form without ultrasonics does not create the ion exchange that permanently reduces the viscosity by cracking and shortening the length of hydrocarbon chains. The proposed use of ultrasonics and a non-polar substance such as pentane reduces the viscosity by reducing the length of chain of the hydrocarbon in bitumen form. Smaller hydrocarbon chains have a lower viscosity. This allows the extraction of oil products from the formation and their transportation to an upgrading process without the use of steam, heat and other high cost processes.

Low Pressure and Low Temperature

Surprisingly, the field test demonstrated a low pressure during the field test. This low pressure may be due to adhesion of the liquid solvent into the formation causing an overall volume reduction from the associated diffusion process. This pressure reduction allows this technology to be used without fear of explosions or blowouts. The low pressure is also important in the use of this invention in shallow wells and for easier injection and/or penetration of the solvent into the oil formation.

The formation is a heat sink which absorbs the heat produced by ultrasonics and there is therefore no danger of explosions from heat, pressure or chemical reaction. This is particular true in the absence of oxygen. The temperature in the region of the transducer in formation rose from about 12 degrees C. to about 14.5 degrees C. and remained at that temperature for about 5 days while the transducer was turned on. The temperature a meter above the transducer in the wellbore remained constant at about 12 degrees C. This is a minimal localized temperature increase which led us to understand the nature of the heat sink of the formation itself.

As indicated in the field test results, the pressure dropped due to a change in volume resulting from the creation of an expanding solvent/bitumen solution. As bitumen dissolves in the non-polar substance, there is an overall decrease in volume by about 5-7%. The forces created from this change in volume are significant. This enabled the injection of solvent deeper into the formation by releasing the solvent at higher pressure at surface wellhead location. The negative pressure difference from surface to formation does the work of injection and removes the necessity of high-pressure injection pumps.

Using this in situ technology removes the requirement of a container at surface. As it is not necessary to contain the oil sand or bitumen in a sealed container in situ and the formation acts as a heat sink, the negative consequences of high pressure and high heat are removed. Use of this technology at surface should take this into consideration in designing semi-enclosed containment, or alternative ways to manage heat and pressure.

Non-Polar Substance as Solvent and Ultrasound Medium

The inventor found that process presented in this study may be optimized using a linear hydrocarbon as a solvent. Experiments using alkanes work but did not show optimal results. Linear hydrocarbon solvents in absence or in low quantities of polarized compounds such as water and oxygen may be optimal.

Transducers

Ultrasonic equipments, including the one used in the field test, usually carry warnings not to use it in the presence of gasoline or other flammable substances. Therefore, the challenge was how to use the ultrasonic equipment safely at depth in a wellbore in the presence of hydrocarbons and flammable substances. The in situ tests provided herein demonstrate that ultrasonic equipment can be safely used for the processes of the present invention.

Transducers can be created or sourced to emit various frequencies of ultrasonic waves to optimize the specific refinement of bitumen. Multiple or single transducers stacked in series or parallel can be used based on the length of well bore or bed in a vertical or horizontal array; or the size of oil sand area/volume when used at surface.

Downhole Specifications

The in situ technique of the present invention may be done at various depths since high pressures are not involved.

It is important to have maximum exposure of the transducer to the oilsand bed. This could look like perforated wellbores, windows, no casing, a cavity in the formation, and so forth.

The use of capped well-head may allow for controlling negative pressure effects and for preventing air to enter the wellbore during the process in order to prevent combustion, but it may not be necessary. Likewise, the well bore is only needed to insert the ultrasonic tool and inject the non-polar substance into the formation. This means that the well bore casing can end at the top of the formation.

Applications

The present invention relates to the use of ultrasonics, hydrocarbon solvents without the addition of polar fluids, such as water, in methods that involve creating a chemical chain reaction in hydrocarbons that reduces the length of hydrocarbon chains in a cracking mechanism, both in situ and in formation. This process can be used in various applications including: well stimulation, well cleaning, extraction, separation and refinement of bitumen and hydrocarbons from an underground formation both shallow and deep, and tailing pond separation. This technology can be used in:

(a) Both in new and existing wells;
(b) Batch processing of above ground oil sand material;
(c) Surface oil sands applications;
(d) Enhancement or improvement on existing SAGD wells;
(e) Perforated down hole casing;
(f) in situ or in surface;
(g) Bitumen and heavy oils in oil sands;
(h) [blank]
(i) Well stimulation;
(j) Well cleaning;
(k) Separation of sand from oil for ease of extraction/separation;
(l) Medium to shallow wells—ability to produce;
(m) Oxygen or no oxygen;
(n) Cracking—refined oil;

CONCLUSIONS

It is possible to deliver high voltage, high frequency into a well bore with safety and run an ultrasonic tool in situ.

Ultrasonically stimulated hydrocarbon fluid acts as an extremely rapid and effective solvent to dissolve bitumen containing long chain hydrocarbon molecules.

The stimulated ultrasonic hydrocarbon liquid, in dissolving surrounding oil sand, produces more ultrasonically stimulated hydrocarbon liquid and an ever-growing chamber of liquid hydrocarbon liquid is created for as long as the ultrasonic tool is running. This chamber will increase in size until the acoustic energy added to the liquid is equal to the energy loss to the surrounding matrix. This is a very large volume. Ultrasonic stimulation of a hydrocarbon liquid with long chain hydrocarbon molecules will cause long chain molecules to break down into shorter molecular chains and thereby refine hydrocarbons. This process can be used in situ, on the surface, or in containers.

I claim:

1. An in situ method of extracting hydrocarbons from an oil formation comprising bitumen, wherein said method comprises:

(a) if there is any excess water, removing the excess water in a well bore in the oil formation,
(b) disposing a nonpolar ultrasonic medium that consists essentially of pentane into the well bore in the oil formation to allow the non-polar ultrasonic medium to contact the hydrocarbons in the oil formation,
(c) placing an ultrasonic transducer in direct contact with the ultrasonic medium which in turn is in direct contact with the hydrocarbons in the oil formation and subjecting the ultrasonic medium in contact with the hydrocarbons in the oil formation to ultrasonic vibrations, while keeping a temperature of the non-polar ultrasonic medium below 160 degrees Centigrade, and
(d) extracting the hydrocarbons from the well bore in the oil formation, wherein the non-polar ultrasonic medium, and wherein the extracted hydrocarbons contain more $C_6$ and $C_{12}$ alkane species and less $C_9$ and $C_{20}$ alkane species relative to the hydrocarbons in the oil formation.

2. The in situ method of claim 1, wherein the non-polar ultrasonic medium disposed into the well bore does not require external addition of heat.

3. The in situ method of claim 1, wherein said non-polar ultrasonic medium consists of pentane.

4. The in situ method of claim 1, wherein said non-polar ultrasonic medium does not contain oxygen as part of its molecular structure.

5. The in situ method of claim 2, wherein said method is performed in the absence of oxygen.

6. The in situ method of claim 1, wherein said non-polar ultrasonic medium is disposed into the well bore and the hydrocarbons are extracted through said well bore.

7. The in situ method of claim 1 wherein said oil formation is an oil sand formation comprising the bitumen.

8. An in situ method of separating hydrocarbons from a hydrocarbon matrix in an oil formation comprising bitumen, wherein said method comprises: (a) if there is excess water, removing the excess water in a well bore in the oil formation, (b) disposing a non-polar ultrasonic medium that consists essentially of pentane into the well bore in the oil formation to allow the non-polar ultrasonic medium to contact the hydrocarbons in the oil formation, and (c) placing an ultrasonic transducer in direct contact with the ultrasonic medium which in turn is in direct contact with the hydrocarbons in the oil formation and subjecting the ultrasonic medium in contact with the hydrocarbons in the oil formation to ultrasonic vibrations, thereby separating in situ the hydrocarbons from the hydrocarbon matrix in the oil formation while keeping a temperature of the non-polar ultrasonic medium below 160 degrees Centigrade, wherein the separated hydrocarbons contain more $C_6$ and $C_{12}$ alkane species and less $C_9$ and $C_{20}$ alkane species relative to the hydrocarbons in the oil formation.

9. The in situ method of claim 8, wherein the non-polar ultrasonic medium does not require external addition of heat.

10. The in situ method of claim 8, wherein said non-polar ultrasonic medium is consists of pentane.

11. The in situ method of claim 8, wherein said non-polar ultrasonic medium does not contain oxygen as part of its molecular structure.

12. The in situ method of claim 9, wherein said method is performed in the absence of oxygen.

13. The in situ method of claim 8, wherein said non-polar ultrasonic medium is disposed into the well bore and the hydrocarbons are extracted through said well bore.

14. The in situ method of claim 8 wherein said oil formation is an oil sand formation comprising the bitumen.

15. An in situ method of refining heavy crude oil in an oil formation comprising bitumen, wherein said method comprises: (a) if there is excess water, removing the excess water in a well bore in the oil formation, (b) disposing a non-polar ultrasonic medium that consists essentially of pentane into the well bore in the oil formation to allow the non-polar medium to contact the heavy crude oil in the well bore, (c) directly contacting an ultrasonic transducer with the ultrasonic medium which in turn is in direct contact with the heavy crude oil in the well bore and subjecting the ultrasonic medium in contact with the heavy crude oil in the well bore to ultrasonic vibrations while keeping a temperature of the non-polar ultrasonic medium below 160 degrees Centigrade, and (d) recovering hydrocarbons from the well bore, wherein the refined heavy crude oil contains more $C_6$ and $C_{12}$ alkane species and less $C_9$ and $C_{20}$ alkane species relative to unrefined heavy crude oil in the formation.

16. The in situ method of claim 15, wherein the non-polar ultrasonic medium does not require external addition of heat.

17. The in situ method of claim 15, wherein said non-polar ultrasonic medium is consists of pentane.

18. The in situ method of claim 15, wherein said non-polar ultrasonic medium does not contain oxygen as part of its molecular structure.

19. The in situ method of claim 16, wherein said method is performed in the absence of oxygen.

20. The in situ method of claim 15, wherein said non-polar ultrasonic medium is disposed into the well bore and the hydrocarbons are extracted through said well bore.

21. The in situ method of claim 15 wherein said oil formation is an oil sand formation comprising the bitumen.

22. An in situ method of processing an oil formation comprising bitumen, wherein said method comprises: (a) if there is excess water, removing the excess water in a well bore in the oil formation (b) disposing a non-polar unheated ultrasonic medium that consists essentially of pentane into the well bore in the oil formation to allow the non-polar unheated ultrasonic medium to contact hydrocarbons in the oil formation, (c) placing an ultrasonic transducer in direct contact with the ultrasonic medium which in turn is in direct contact with the hydrocarbons in the well bore in the oil formation and subjecting the ultrasonic medium in contact with the hydrocarbons in the oil formation to ultrasonic vibrations while keeping a temperature of the non-polar ultrasonic medium below 160 degrees Centigrade, and (d) extracting the processed hydrocarbons from the oil formation through said well bore, wherein the processed hydrocarbons contain more $C_6$ and $C_{12}$ alkane species and less $C_9$ and $C_{20}$ alkane species relative to unprocessed hydrocarbons in the oil formation.

* * * * *